US005594423A

United States Patent [19]

East

[11] Patent Number: 5,594,423

[45] Date of Patent: Jan. 14, 1997

[54] TOILET LID ALARM AND METHOD

[76] Inventor: Kenneth H. East, 4689 Adrian Way, Plano, Tex. 75024

[21] Appl. No.: 498,564

[22] Filed: Jul. 6, 1995

[51] Int. Cl.[6] ..... G08B 21/00

[52] U.S. Cl. ..... 340/686; 340/689; 340/527; 4/661

[58] Field of Search ..... 340/686, 689, 340/527, 540; 4/661

[56] References Cited

U.S. PATENT DOCUMENTS 4,253,095 2/1981 Schwarz et al. ..... 340/689
4,491,991 1/1985 Herbrnok ..... 4/661
4,706,064 11/1987 Hwang ..... 340/430
4,849,742 7/1989 Warrington ..... 340/686
4,980,666 12/1990 Hwang ..... 360/428

*Primary Examiner*—Brent A. Swarthout
*Assistant Examiner*—Benjamin C. Lee
*Attorney, Agent, or Firm*—Ralph Bailey, P.A.

[57] ABSTRACT

A battery operated, self-contained toilet lid alarm system for alerting adults in a household with small children that a toilet lid is open and thus presenting a danger of drowning or serious injury to the children utilizes a time delay switch contained in a housing (A) to deactivate the alarm for selected periods of time allowing the system to reactivate itself after the delay is over emitting a noise to alert adults within the vicinity of the toilet, even when the toilet lid is only partially open.

2 Claims, 5 Drawing Sheets

Fig. 3.
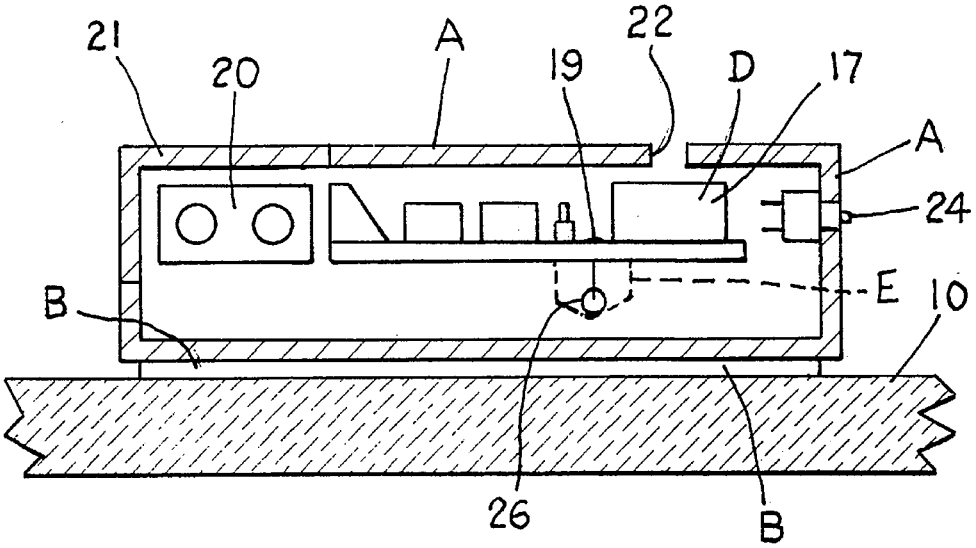
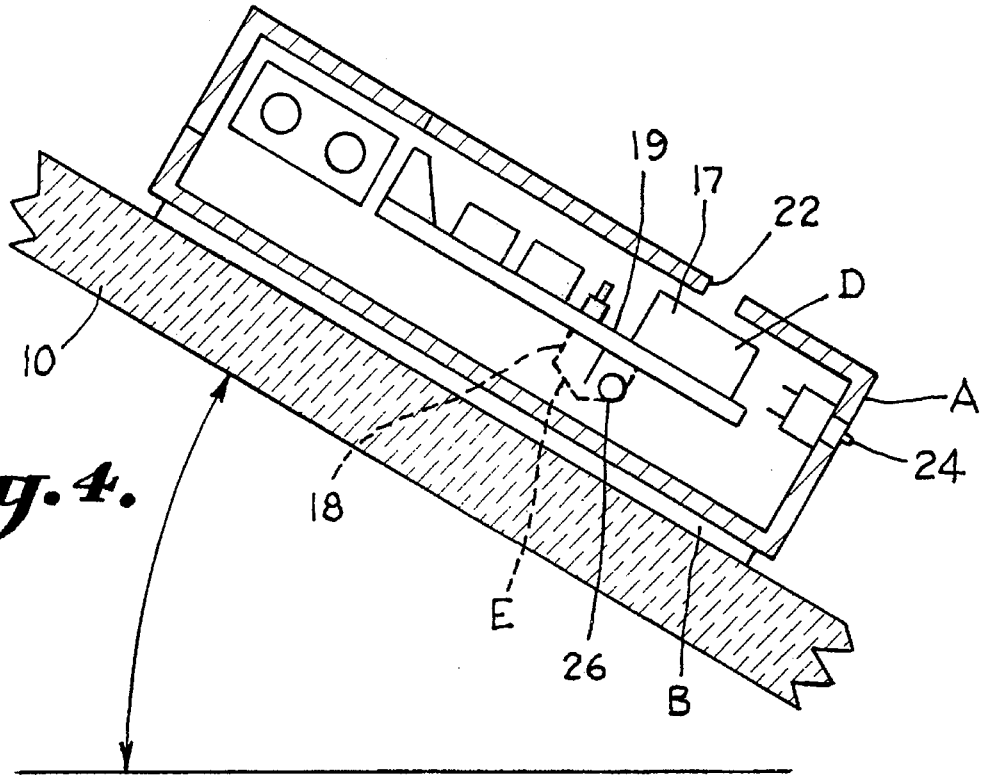
Fig. 4.

TOILET LID ALARM AND METHOD

BACKGROUND OF THE INVENTION

This invention relates to an alarm device and method utilizing a position controlled switch for giving a warning that a child has opened a toilet lid.

Every year, many young children drown or become severely and permanently injured when they fall into toilet bowls that were left open by adults, or were opened by the children themselves. Toilet lid locks are readily available in many different designs, but their effectiveness is dependent upon the user of the toilet remembering to close and lock the toilet lid. Efforts have also been made to provide devices to remind the user of a toilet to close the lid after use, but none of these have proved to be satisfactory or fully effective.

Efforts to solve the problem include apparatus disclosed in U.S. Pat. No. 4,849,742, but that solution is problematical in that it is activated only for a limited period of time. Since the danger of a child drowning in a toilet does not diminish after some limited time period, this alarm system would be less than satisfactory as a safeguard against toilet drownings. Also, the signaling device is actuated only after the lid has been fully opened and is resting against the water tank. Because many drownings take place while the lid is not fully opened, the patented device would not prevent those accidents. Furthermore, the patent discloses a device that only actuates the alarm when the toilet has been flushed and the water tank is empty. Accidents often occur in toilets that have not been flushed, and the patented device would not prevent those accidents. Finally, the patented device has several separate components, which does not make for ease of installation.

The following U.S. Patents further illustrate the state of the art: Nos. 4,055,864, 4,462,023, 4,484,186, 4,995,120, and 4,736,471.

SUMMARY OF THE INVENTION

Accordingly, it is an important object of this invention to alert the adult members of a household, after a user selected amount of time, when a toilet lid has accidentally been left open.

It is another object of the invention to alert adults immediately when a toilet lid has been opened by a child.

It is another object of this invention to provide a childproof mechanism for disabling the signaling device which includes a signaling delay.

This invention further contemplates providing a signal if the lid is only partially opened.

It is still another object of the invention to continue enablement of the signaling device until either the lid is closed or a signaling delay is entered by the user.

Another object of this invention is to provide a completely self-contained unit that requires no external power, which can operate on any style toilet that has a toilet lid.

The apparatus includes a plastic base unit or housing that contains all of the operating components. This base unit has a cover over the base unit, and this cover is attached in such a way as to keep a small child from being able to remove the cover. The base unit is attached to the toilet lid through the use of an adhesive pad. The adhesive pad attaches the device to the lid securely enough to prevent a small child from removing the device from the lid, but still allows removal by an adult. Two small switches-protrude from the base, and these switches are used to activate the time delay mechanism that allows adults and older children to delay actuation of the alarm for a predetermined period of time. The power source for this system is a battery, which is located in a receptacle within the base unit under the cover so that a small child is precluded from gaining access thereto.

A signaling device is located within the base unit, and is activated by a position operated switch also located within the base unit. The position operated switch is mounted in such a way so that the base unit may be mounted in any desirable orientation upon the surface of the toilet lid without affecting the ability of the system to perform its designated function. The apparatus also includes a printed circuit board and associated electronics, which may be programmed regarding the delay times of the alarm.

The method contemplates the position operated switch being set to actuate the alarm at a predetermined angle of the toilet lid. It is important that the alarm be activated when the toilet lid is at a small angle, such as 15°, ensuring that the alarm will be enabled when the lid is only slightly opened.

The signal will be audible for a predetermined period of time, and then will remain silent for a predetermined amount of time. Then, the sequence will repeat itself until the device is disabled. This pattern is intended to reduce power consumption in order to extend battery life, and to make the signal more noticeable in a noisy environment.

The signaling device may be disabled in several ways. Closing of the toilet lid will disable the device, such that the toilet lid is either fully closed or at a predetermined angle. Alternatively, the protruding switches may be used to select one of five delay time periods. When one of the delay times is selected, the signaling device is disabled for the specified amount of time. If the toilet lid is still open at the end of the delay time, the signaling device will be enabled and an alarm will sound.

The switches may be operated in a predetermined sequence in order to actuate the delay mechanism. For example, if a user presses the switches in an invalid sequence, the sequence is ignored. These switches provide a childproof mechanism for delaying the enablement of the signaling device.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 3 is a side elevation illustrating components of the alarm system wherein the housing A is fixed to the toilet lid 10;

FIG. 4 is a side elevation similar to FIG. 3 illustrating the mercury switch as being open for actuating a signal upon raising of a lid through a predetermined angle;

DESCRIPTION OF A PREFERRED EMBODIMENT

The drawings illustrate a toilet lid alarm including a housing A. An adhesive B or other suitable attachment means is carried by the housing for securing the housing to a surface of the lid. A receptacle C is provided for a battery carried by the housing. An alarm device D for supplying an audible signal is carried by the housing. A position operated switch E is carried by the housing actuating the alarm device when the toilet lid is raised in excess of a predetermined angle. Thus, an audible signal is given indicating that the lid has been raised. Suitable push button switch actuator means F extend from the housing for deactivating the position operated switch.

Figure 1:
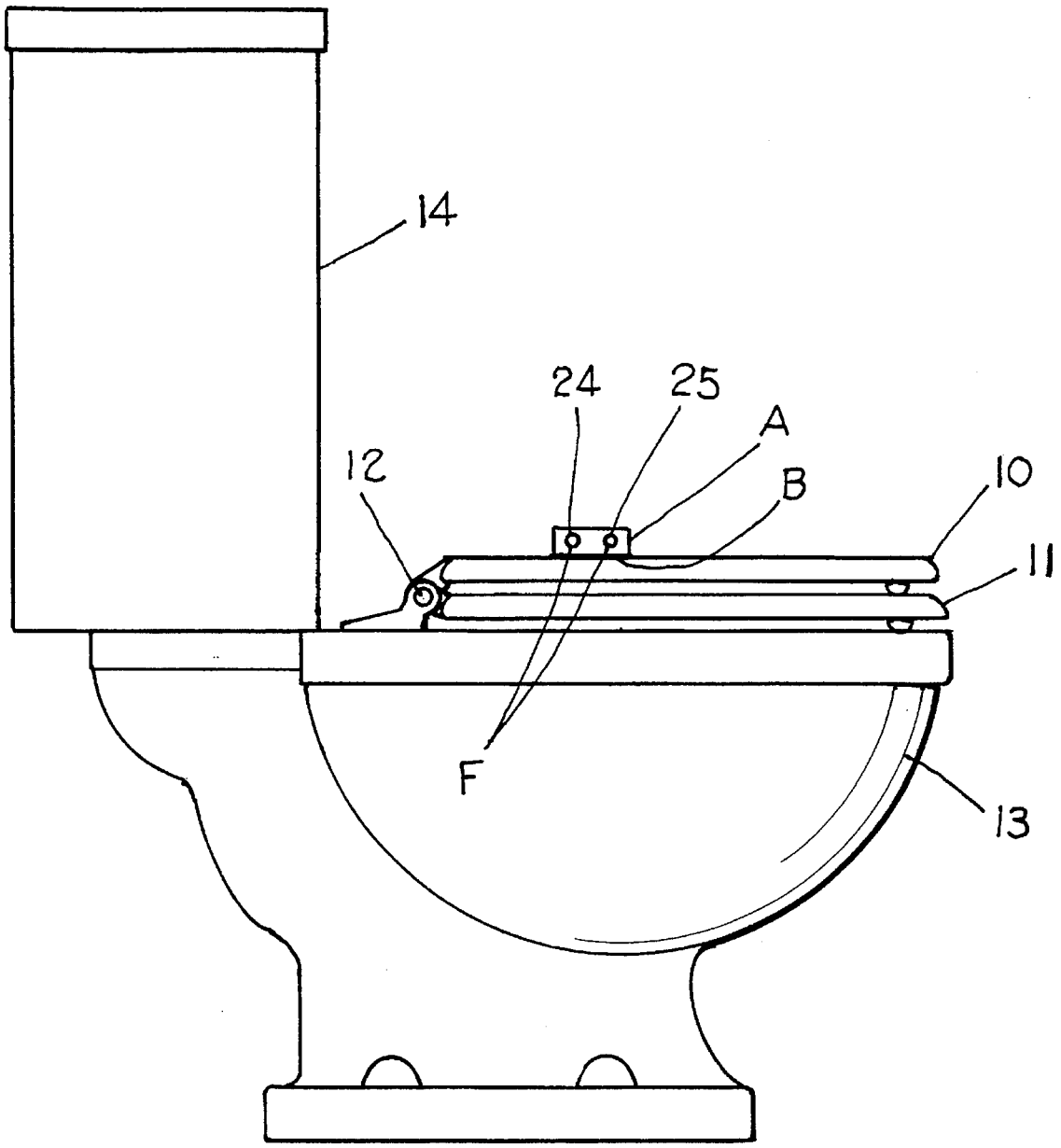
FIG. 1 is a side elevation illustrating a switch constructed in accordance with the invention positioned upon a closed lid of a toilet bowl.
Figure 2:
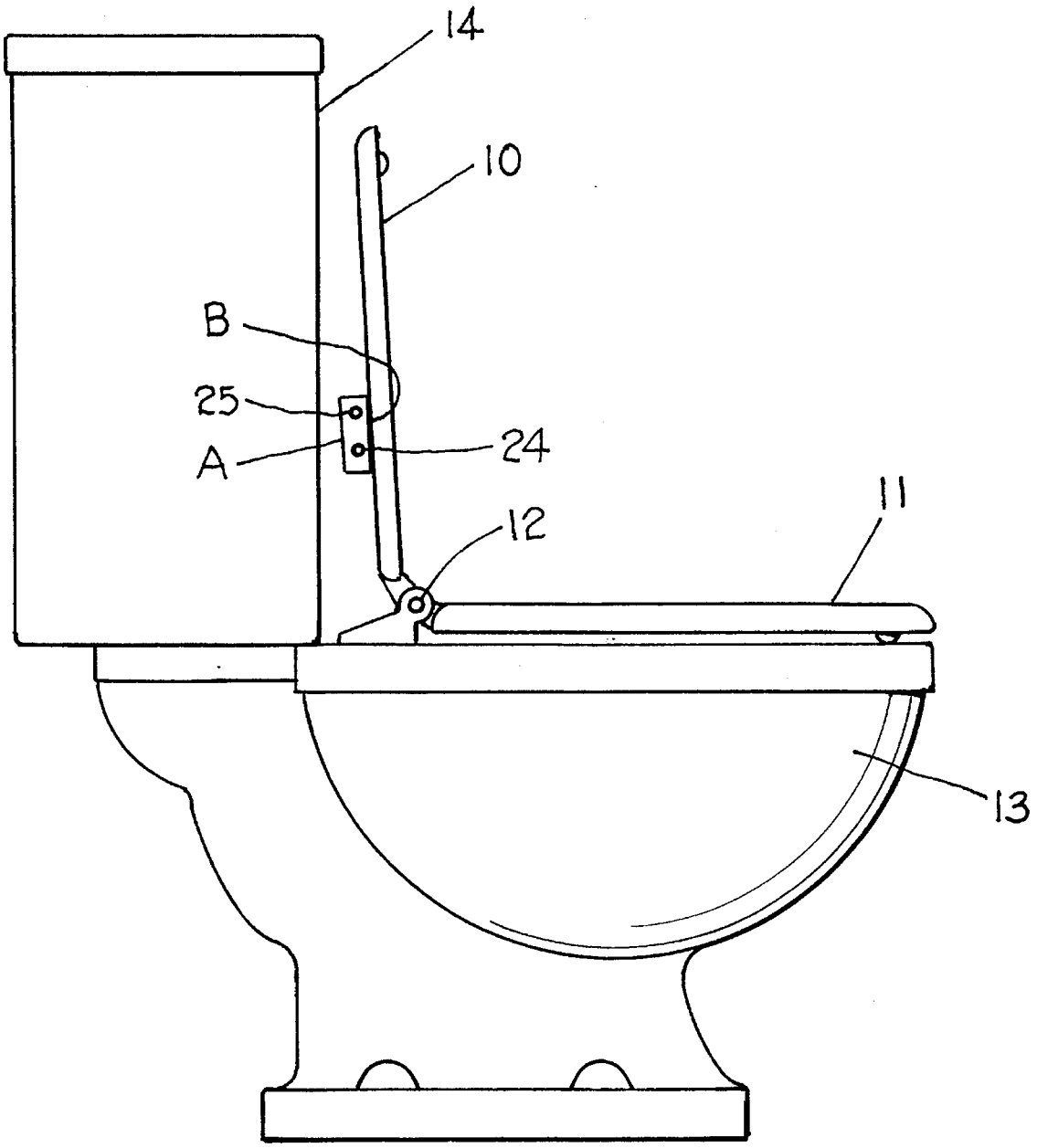
FIG. 2 is a side elevation similar to FIG. 1 but illustrating the lid in fully raised position placing the apparatus in position to give a signal.
Figure 6:
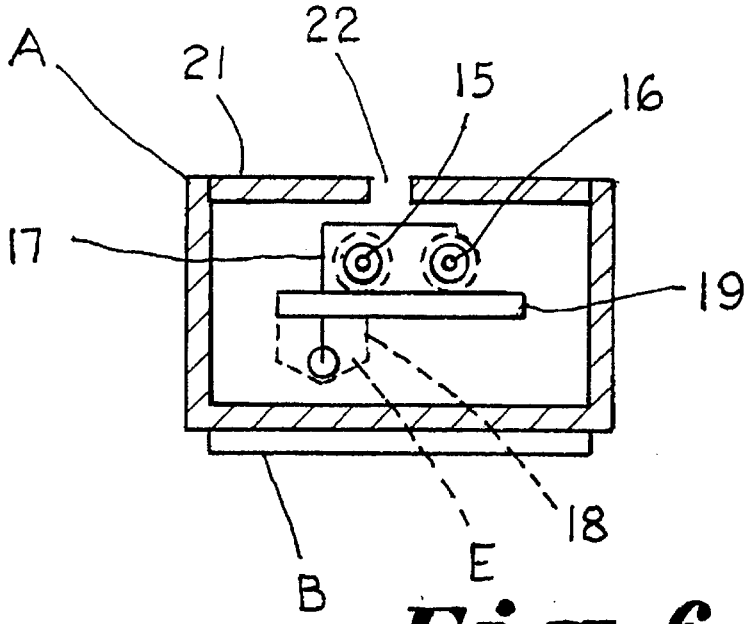
FIG. 6 is an end elevation further illustrating the positioning of the components.
Figure 5:
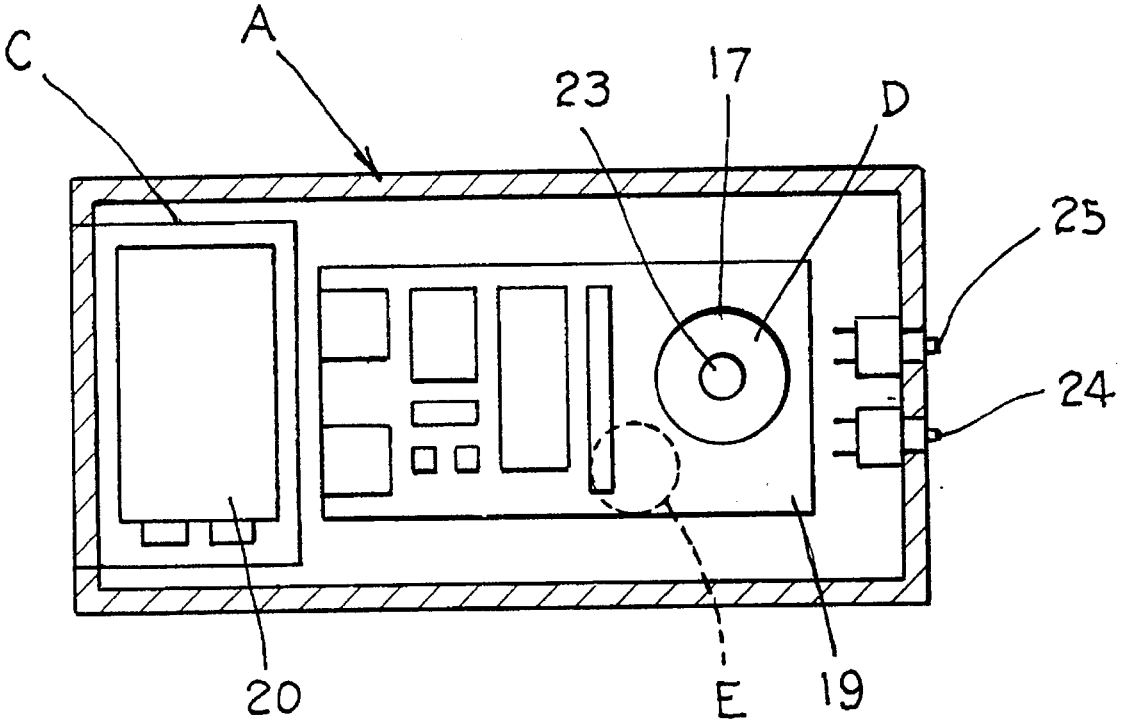
FIG. 5 is a sectional plane view further illustrating the placement of the component of the alarm system.

The housing A is illustrated in FIGS. 2 and 3 as being positioned by the adhesive strip B upon the lid 10 above the seat 11. The lid is pivotally attached as at 12. The seat and the lid are carried by the toilet bowl 13 forwardly of the usual water tank 14.

FIGS. 3 through 6 are schematic diagrams illustrating components within the housing A. The housing A contains normally open, momentary contact switches 15 and 16, the signalling device 17, the mercury tilt switch 18, the single board computer 19, and the battery 20. A battery access cover 21 is provided as a part of the enclosure A. An aperture 22 for the signaling device 17 is located in the enclosure such that it is directly over a corresponding aperture 23 in the signaling device.

The two normally open, momentary contact switches are push button switches that protrude from the enclosure as at 24 and 25. These switches are manipulated by the user of the toilet lid alarm to set the delay period of the signaling device 17.

The signaling device 17 is a self-contained Piezo Alarm with internal circuitry. The mercury tip switch 18 includes a metal container that houses an electrode and a droplet of mercury 26. This mercury tip switch is mounted within the device in such a way that when the toilet lid is closed, the mercury tip switch is also closed as shown in FIG. 3. When the toilet lid is open at greater than a predetermined angle, the mercury tip switch is also open as in FIG. 4. This device may be a T08-1006 switch manufactured by American Electronic Components, Inc.

FIGS. 3 and 4 illustrate the operation of the alarm on the toilet lid. A double-sided adhesive strip or pad B is provided for attachment to the toilet lid 10 in relation to the device. FIGS. 3 indicates the state of the mercury tip switch 18 when the lid is closed. FIG. 4 shows the state of the mercury tip switch 18 when the lid is partially opened. When the toilet lid 10 is closed, the mercury in the tilt switch contacts a suitable electrode. In this position, suitable software together with the hardware determine that the toilet lid 10 is closed, and the signaling device remains silent.

FIG. 4 illustrates the operation of the alarm on the partially open toilet lid and further illustrates the state of the mercury tip switch 18 in an open position. When the toilet lid 10 is opened, the mercury droplet in the mercury tilt switch 18 maintains contact with the electrode, until the toilet lid 10 is opened to a predetermined angle. At this point, the mercury tilt switch 18 ceases to conduct, and the software detects that the toilet lid 10 has been opened. Current will not flow through the mercury tilt switch 18 again until the toilet lid 10 is lowered to an angle lower than the predetermined angle. At this point, the hardware and software detect that the toilet lid 10 has been closed.

Figure 7:
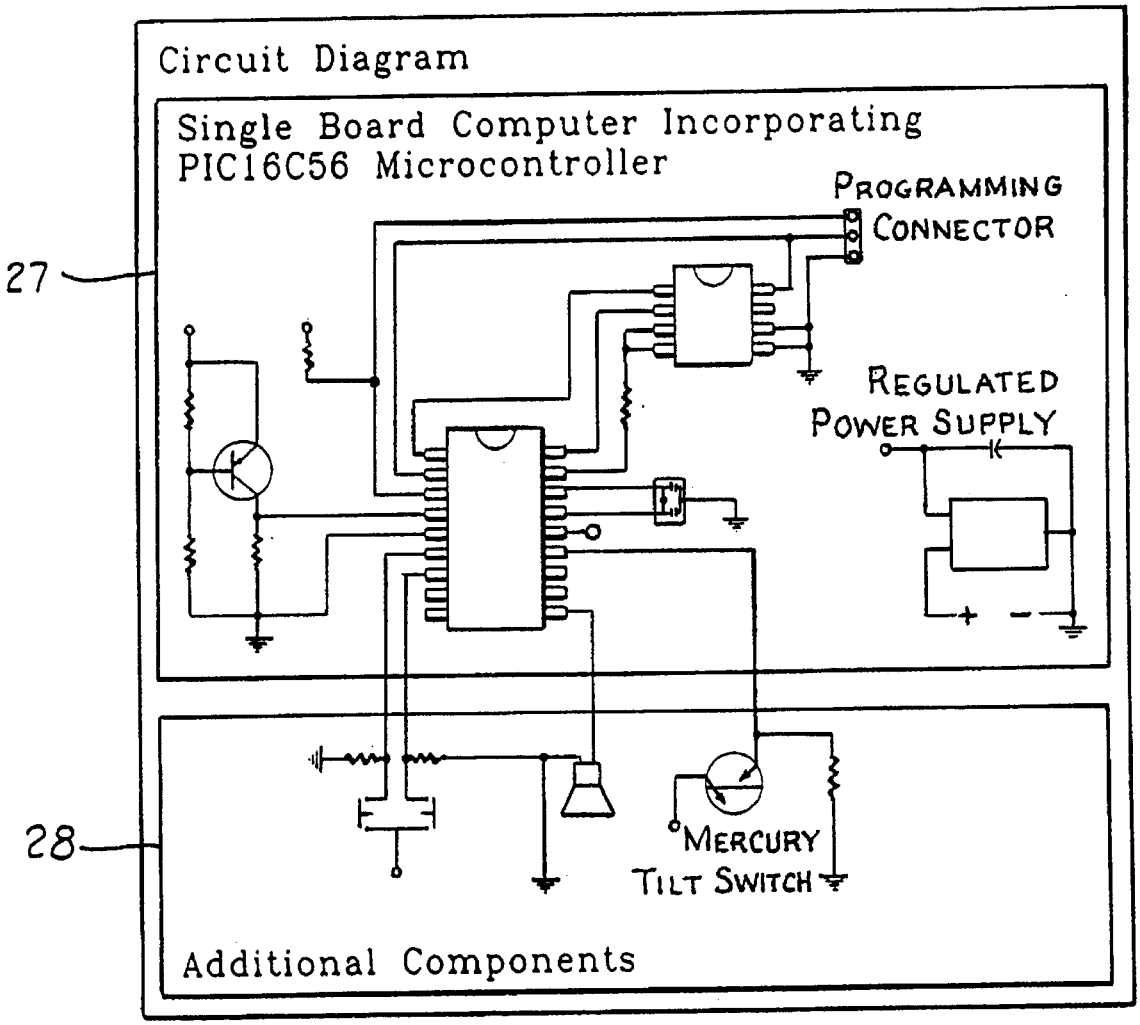
FIG. 7 is a block diagram illustrating the various electrical components of the system.

FIG. 7 is a circuit diagram for a single board computer incorporating the PIC16C56 Microcontroller and additional components. The diagram is divided into two sections. The upper section 27 is a schematic for the single board computer that may be used to build the alarm. The lower section 28 contains the additional circuitry required to create a toilet lid alarm using the single board computer. The single board computer may be a BASIC Stamp manufactured by Parallax, Inc. It contains a PIC16C56 XT Microcontroller that runs a BASIC interpreter, a 256 byte EEPROM that contains a program governing the operation of the stamp. The EEPROM holds a version of a basic program that is required to implement the toilet lid alarm.

The additional components in the lower block are: the signaling device, the mercury tilt switch that detects the toilet lid tilt, the switches for delaying the signaling device, and the components necessary to attach them to the single board computer.

While a preferred embodiment of the invention has been described using specific terms, such description is for illustrative purposes only, and it is to be understood that changes and variations may be made without departing from the spirit or scope of the following claims.

What is claimed is:

1. A toilet lid alarm comprising:

a housing;

means carried by the housing for securing said housing to a surface of said lid;

a receptacle for a battery carried by said housing;

an alarm device powered by said battery for supplying an audible signal carried by said housing;

a position operated switch carried by said housing actuating said alarm device when said toilet lid is raised through a predetermined angle;

a switch actuator on said housing for controlling and deactivating said position operated switch; and a time delay after deactivating said position operated switch, so that said position operated switch is reactivated after said time delay;

whereby an audible signal is given indicating that the lid has been raised.

2. The structure set forth in claim 1 wherein said position operated switch is gravity actuated.

* * * * *